United States Patent [19]

Garofalo

[11] 3,979,069

[45] Sept. 7, 1976

[54] AIR-ATOMIZING FUEL NOZZLE

[76] Inventor: Luigi Garofalo, 1583 Sunview Road, Lyndhurst, Ohio 44124

[22] Filed: Oct. 11, 1974

[21] Appl. No.: 514,118

[52] U.S. Cl. ..... 239/400; 239/405; 239/406

[51] Int. Cl.[2] ..... B05B 1/34

[58] Field of Search ..... 239/400, 402, 404, 405, 239/406; 60/39.74 R

[56] References Cited

UNITED STATES PATENTS

| | | | |
|---|---|---|---|
| 1,451,063 | 4/1923 | Anthony | 239/406 |
| 1,593,186 | 7/1926 | McKean et al. | 239/405 X |
| 1,736,768 | 11/1929 | Boynton | 239/400 |
| 2,103,958 | 12/1937 | Stillman | 239/404 |
| 2,155,986 | 4/1939 | Wheaton | 239/400 X |
| 2,303,104 | 11/1942 | Abbey | 239/404 |
| 2,567,485 | 9/1951 | Jenny | 239/406 |
| 3,844,484 | 10/1974 | Masai | 239/404 |
| 3,866,413 | 2/1975 | Sturgess | 239/400 X |

*Primary Examiner*—John J. Love
*Attorney, Agent, or Firm*—Donnelly, Maky, Renner & Otto

[57] ABSTRACT

A nozzle for atomizing fuel for use in gas turbines and the like especially suitable for atomizing fuels of high viscosity, said nozzle having a fuel swirl chamber with a trumpet or funnel-shaped orifice along which the fuel flows as a swirling conical sheet and being characterized in that said trumpet or funnel-shaped portion is perforated for admission of compressed air in swirling fashion to atomize the swirling conical sheet of fuel.

4 Claims, 6 Drawing Figures

AIR-ATOMIZING FUEL NOZZLE

BACKGROUND OF THE INVENTION

Fuel atomizing nozzles for use in gas turbines and the like commonly employ compressed air to atomize the fuel. It is also well known to employ fuel swirl chambers to produce a hollow conical form of spray. These features may be combined as disclosed in U. S. Pat. No. 3,474,970 in which compressed air is fed around the outside of an extended conical discharge orifice of a swirl chamber to atomize the conical sheet of fuel emerging from the edge of the discharge orifice. It is also well known to introduce compressed air to the inside of a fuel swirl chamber to obtain mixing of the fuel and air in order to improve atomization. A disadvantage of both of such devices is that the quantity of air which can be brought into intimate contact with the fuel is limited by geometric considerations; in the first case because the air and fuel sheets necessarily have to follow approximately parallel directions, and in the second case because the discharge orifice size is limited by the hydraulic design considerations especially if, as is usually the case, the resultant spray cone angle must be held to a desired value. As a result, in both cases insufficient air can be utilized to obtain satisfactory atomization under all conditions particularly those of high fuel flow rates and/or high fuel viscosity.

Economic and supply considerations are at present dictating the use of fuels of lower quality and higher viscosity than heretofore and, hence, it is important to obtain good fuel atomization in order to satisfy general requirements for both fuel economy and atmospheric pollution standards.

SUMMARY OF THE INVENTION

A principal object of the present invention is to provide a fuel nozzle in which the quantity of compressed air which can be supplied to the nozzle is independent of the hydraulic design limitations.

Another object of this invention is to provide a nozzle in which the air is supplied in a manner to maximize the fuel atomizing effect thereof.

Yet another object of this invention is to maintain adequate control of the conical shape of the fuel spray under widely varying conditions of operation.

Yet another object of this invention is to provide a fuel atomizing nozzle which can readily be combined with other known features of a gas turbine combustion chamber such as swirl vanes for admitting air to the primary combustion zone of the combustion chamber.

Yet another object of this invention is to provide a simplified nozzle construction having large fuel passages which are more suitable for use with low quality fuels of high viscosity and which may contain substantial amounts of solid particles.

Yet another object of this invention is to provide a nozzle having means for admitting a portion of the compressed air around the outer edge of the discharge trumpet or funnel to eliminate the collection of large drops of fuel at this point.

Yet another object of this invention is to provide a nozzle having means as aforesaid which are so arranged as to insure even circumferential distribution of said portion of the compressed air which is admitted around the outer edge of the discharge trumpet or funnel.

DETAILED DESCRIPTION OF THE PREFERRED EMBODIMENTS

Figure 1:
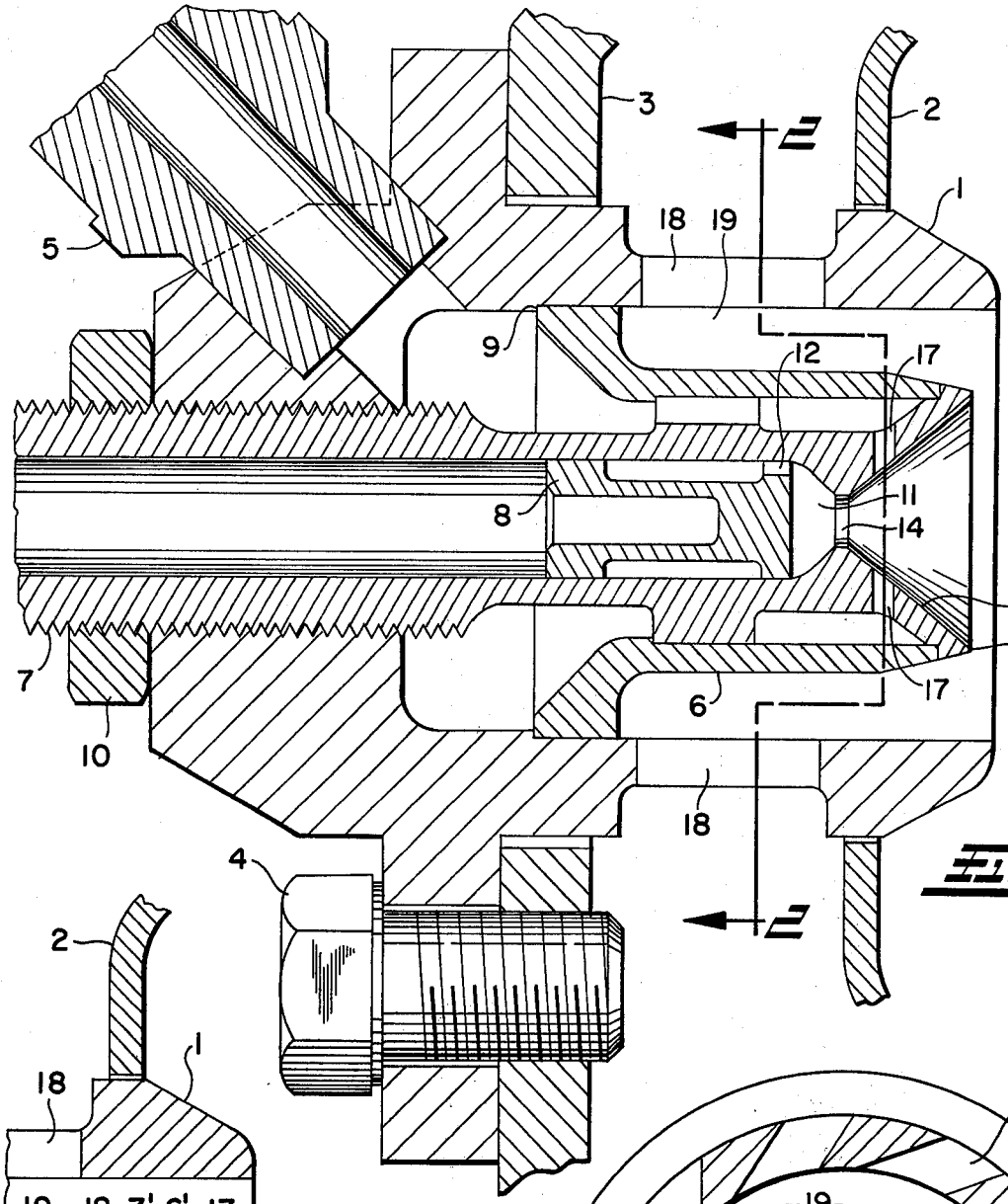
FIG. 1 is a central longitudinal cross-section view of a fuel nozzle having a perforated trumpet or funnel-shaped discharge orifice portion through which tangential jets of compressed air are admitted to atomize the swirling conical fuel sheet flowing toward the mouth of said trumpet or funnel-shaped discharge orifice.
Figure 2:
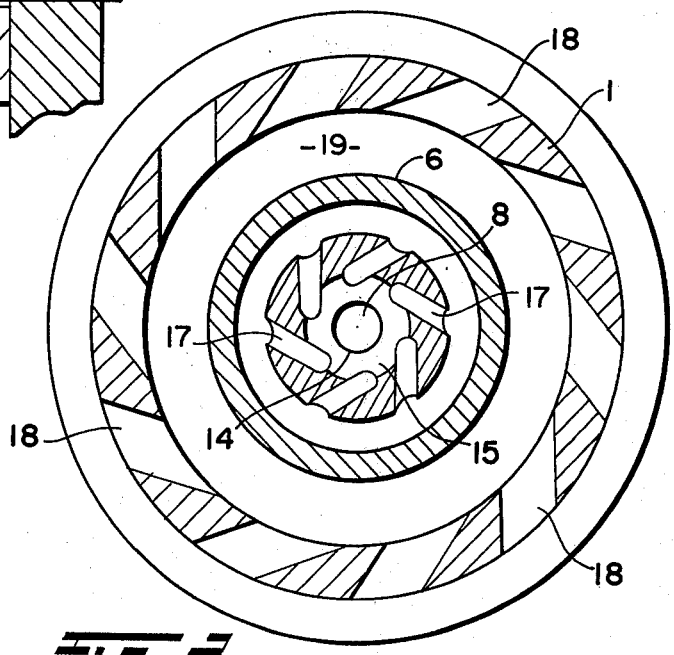
FIG. 2 is a transverse cross-section view taken substantially along the line 2—2, FIG. 1.

Referring first to FIGS. 1 and 2, the fuel nozzle comprises a nozzle housing 1 inserted through an opening in the front end or dome of a combustion chamber liner 2 and is secured to the combustor outer casing 3 with screws 4 as shown. The nozzle housing 1 includes a boost air inlet fitting 5, a sleeve 6 which separates the boost air from the standard compressor air, and a threaded nozzle body 7 which contains a fuel swirl plug 8, the nozzle body 7 being screw-threaded into the nozzle housing 1 and serving to clamp the sleeve 6 against the shoulder 9, the nozzle body 7 being locked as by means of the lock nut 10. As shown, the nozzle body 7 and fuel swirl plug 8 define a swirl chamber 11 into which fuel is fed through the angled slots 12. The discharge orifice 14 is extended to form a conical trumpet or funnel 15 which terminates in a sharp edge 16. The trumpet 15 is perforated by a series of tangentially disposed holes 17 which have centers lying in a plane normal to the axis of the discharge orifice 14 and trumpet 15. The nozzle housing 1 admits air from the combustor through angled passages 18 as shown in FIGS. 1 and 2 to produce a swirling air flow through the annular passage 19 defined between the bore of the nozzle housing 1 and the outer surface of the sleeve 6.

Figure 3:
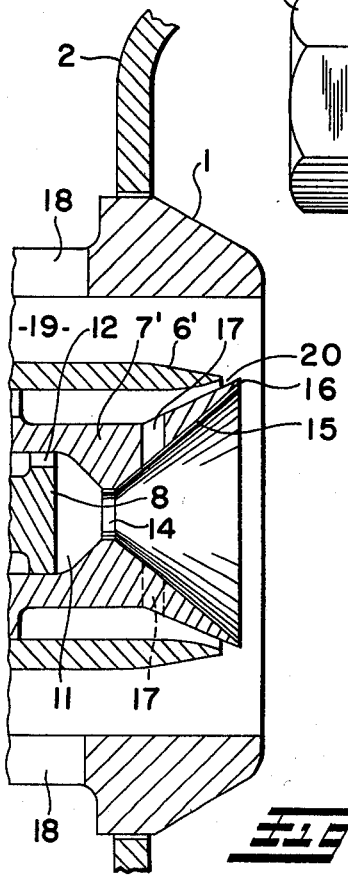
FIG. 3 is a fragmentary longitudinal cross-section view of a modified form of nozzle similar to that of FIG. 1.

The fuel nozzle shown in FIG. 3 may be of the same construction as just described in relation to FIGS. 1 and 2 except that the downstream ends of the sleeve 6′ and nozzle body 7′ define an additional annular air passage 20 immediately upstream of the sharp edge 16 of the trumpet 15.

Figure 4:
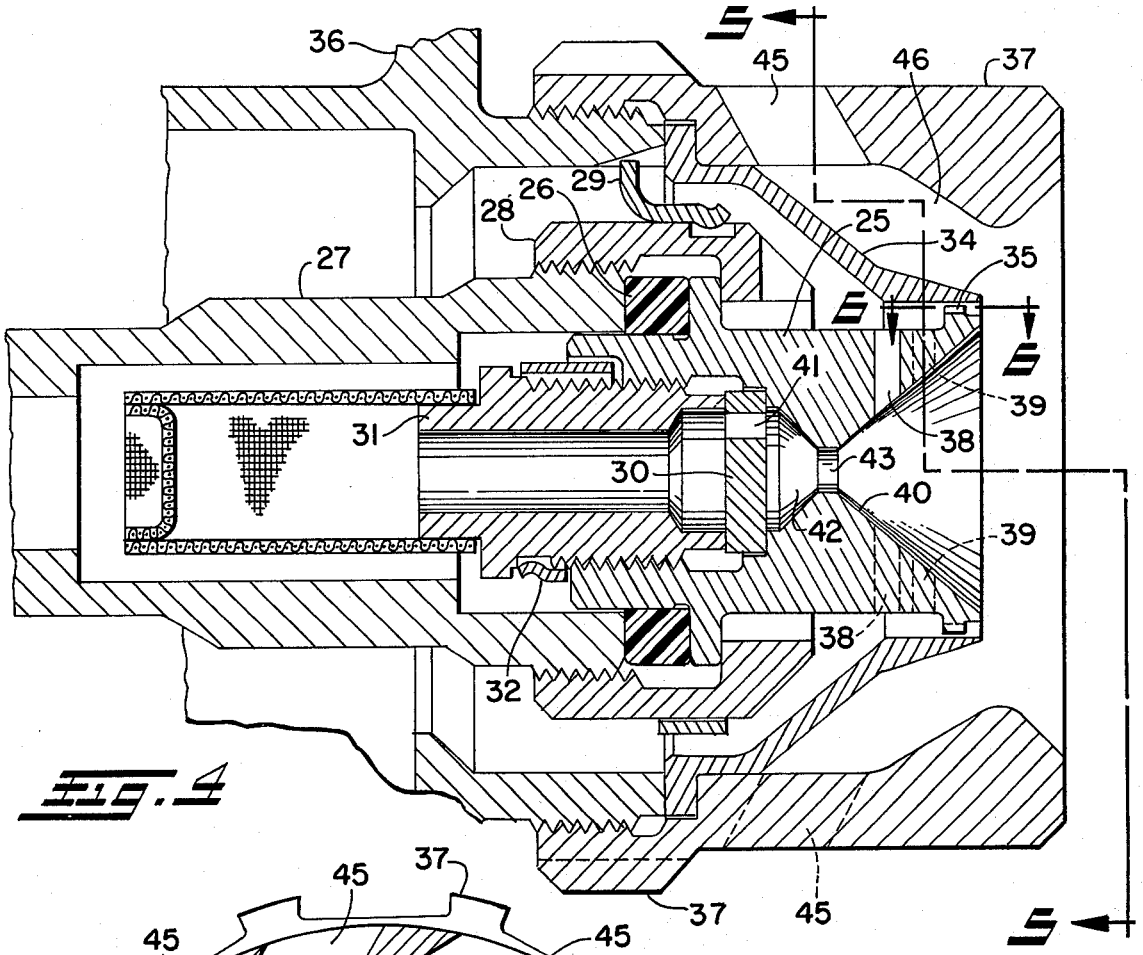
FIG. 4 is a longitudinal cross-section view of yet another form of fuel nozzle embodying the present invention.
Figure 5:
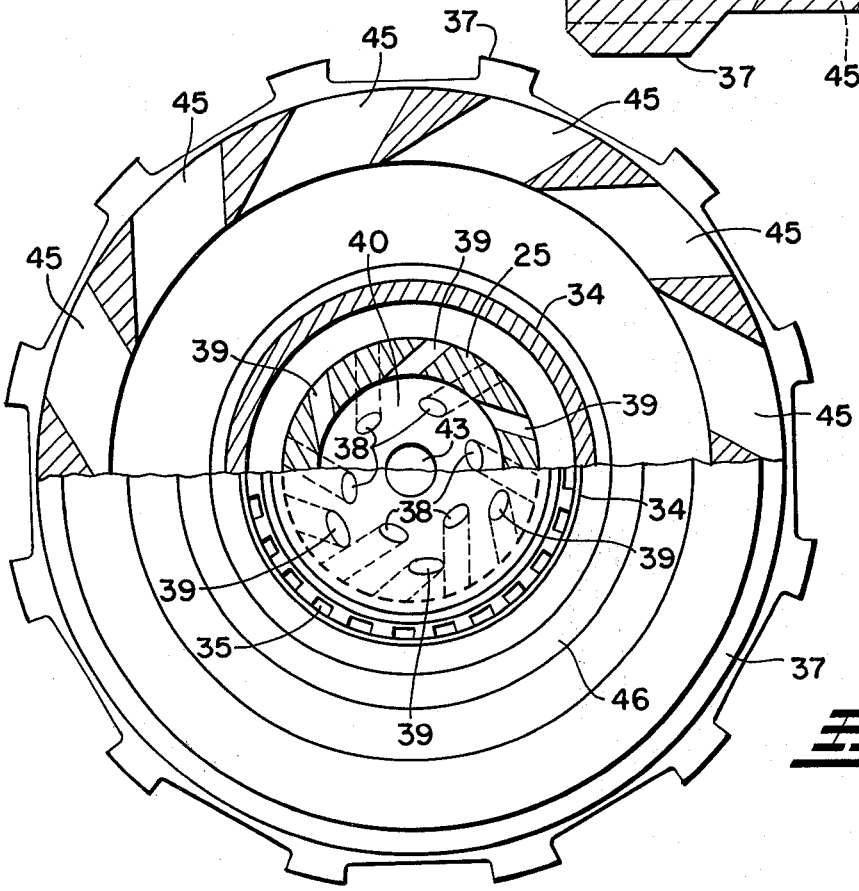
FIG. 5 is a transverse cross-section view taken substantially along the line 5—5, FIG. 4.
Figure 6:
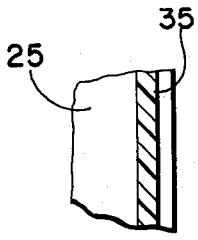
FIG. 6 is a fragmentary elevation view as viewed along the line 6—6, FIG. 4.

FIGS. 4–6 illustrate another embodiment of the fuel nozzle herein and, in this case, the primary body 25 and seal 26 are sandwiched between the fuel manifold 27 and the nut 28, the assembly being retained by a locking tab 29. The primary body 25 has therein a fuel swirl plug 30 which is retained by a threaded member 31 and locked in place by means of a crimp ring 32. The shroud 34 of the nozzle pilots on the serrations 35 which are angled as best shown in FIG. 6, the shroud 34 being held in place between the air boost manifold 36 and the outer nut 37. In this design two rows of holes 38 and 39 are formed in the trumpet 40, the holes 38 of one row being staggered with respect to the holes 39 in the other row so as to effectively overlap in a circumferential sense in relation to the fuel flowing along the surface of the trumpet 40. The swirl plug 30 has angled holes 41 therethrough leading into the swirl chamber 42 for discharge from the orifice 43. The outer nut 37 admits air from the combustor through angled passages 45 to produce a swirling air flow in the annular passage 46 defined between the outer surface of the shroud 34 and the inner surface of said outer nut 37.

In the normal operation of the FIG. 1 nozzle, fuel is fed into the swirl chamber 11 where it forms a free vortex with a hollow center and the fuel then flows over the edge of the discharge orifice and forms a film which in turn flows along the surface of the trumpet 15. The compressed air emerges at high velocity from the series of holes 17 and shears the fuel film at the intersections to cause breakup of the fuel into fine drops. Because the air is admitted into the trumpet 15 in swirling fashion, the resultant cloud of drops is also swirled and the radial component of velocity causes the cloud of drops to generally follow the wall of the trumpet 15 thus producing a hollow conical spray as the fuel-air mixture emerges from the trumpet 15. The hollow conical spray of fuel which is already well mixed with air is then further mixed with the combustion air entering through the annular passage 19 surrounding the fuel atomizing means which is also swirling and generally following the same conical discharge pattern. Preferably, the compressed air will be swirled in the same direction of rotation as the fuel while the combustion air may be swirled in the same or in the opposite direction depending on the degree of turbulence or mixing which may be found necessary in the particular type of combustion chamber to which the present invention is applied.

In FIG. 3 if there is a minor portion of the fuel film which passes the air holes 17 without being atomized it will reach the downstream edge 16 of the trumpet 15 where it will be atomized by the high velocity air fed to the small annular passage 20 which surrounds the edge 16 of the trumpet 15 before mixing with the air from the annular passage.

Basically the FIG. 4 nozzle is like that of FIG. 3 except that two sets of holes 38 and 39 are provided in the trumpet 40 in staggered relation for more complete atomization and, in addition, the angled vanes formed by the serrations 35 introduce compressed air as the atomized fuel emerges from the trumpet 40 and prior to mixing with combustor air in the surrounding annular passage 46.

The embodiments of the invention in which an exclusive property or privilege is claimed are defined as follows:

1. An air-atomizing fuel nozzle comprising a nozzle body assembly defining therewithin a fuel passage, and first and second air passages; a nozzle body means communicating with said fuel passage and having a vortex chamber to impart a whirling motion to the fuel flowing through said fuel passage, and having a discharge orifice with an outwardly flared trumpet portion through which the fuel is discharged in the form of a swirling conical sheet; sleeve means in said assembly isolating said first and second air passages from each other; said trumpet portion between its ends having a circumferential series of holes opening thereinto from said first air passage for discharge of high velocity air jets into said trumpet portion to atomize the swirling conical sheet of fuel as it flows around said trumpet portion; said second air passage surrounding said sleeve means and said trumpet portion to form an annular air discharge passage for mixing of air with the fuel-air mixture emerging from the large end of said trumpet portion; said sleeve means and body means defining therebetween a radially narrow annular air passage at the large end of said trumpet portion, said narrow annular air passage communicating with said first air passage for discharge of high velocity air to further atomize the fuel-air mixture as it emerges from said trumpet portion.

2. The nozzle of claim 1 wherein said second air passage has swirl means for producing swirling air discharge from said annular air discharge passage.

3. The nozzle of claim 1 wherein said narrow annular air passage has swirl means therein.

4. An air-atomizing fuel nozzle comprising a nozzle body assembly defining therewithin a fuel passage, and first and second air passages; a nozzle body means communicating with said fuel passage and having a vortex chamber to impart a whirling motion to the fuel flowing through said fuel passage, and having a discharge orifice with an outwardly flared trumpet portion through which the fuel is discharged in the form of a swirling conical sheet; sleeve means in said assembly isolating said first and second air passages from each other; said trumpet portion between its ends having a circumferential series of holes opening thereinto from said first air passage for discharge of high velocity air jets into said trumpet portion to atomize the swirling conical sheet of fuel as it flows around said trumpet portion; said second air passage surrounding said sleeve means and said trumpet portion to form an annular air discharge passage for mixing of air with the fuel-air mixture emerging from the large end of said trumpet portion; said holes being angularly disposed to provide air jets having a tangential velocity component in the same direction as the tangential velocity component of the swirling conical sheet of fuel; and said sleeve means and body means defining therebetween another annular air discharge orifice communicating with said first air passage for discharge of high velocity air to further atomize the fuel-air mixture immediately upon emergence from the large end of said trumpet portion and prior to mixing with air discharged from said first-mentioned annular air discharge passage.

* * * * *